US007255371B2

(12) United States Patent
Nikodem

(10) Patent No.: US 7,255,371 B2
(45) Date of Patent: Aug. 14, 2007

(54) METHOD AND APPARATUS FOR NOTIFYING A PERSON OF AN APPOINTMENT

(76) Inventor: Gerard P. Nikodem, 10635 Forestlawn, Sunset Hills, MO (US) 63128

( * ) Notice: Subject to any disclaimer, the term of this patent is extended or adjusted under 35 U.S.C. 154(b) by 508 days.

(21) Appl. No.: 10/683,946

(22) Filed: Oct. 10, 2003

(65) Prior Publication Data

US 2004/0108711 A1 Jun. 10, 2004

Related U.S. Application Data

(60) Provisional application No. 60/417,453, filed on Oct. 10, 2002.

(51) Int. Cl.
*B24D 15/00* (2006.01)
*B65D 27/08* (2006.01)

(52) U.S. Cl. ..... 283/62; 283/81; 229/72

(58) Field of Classification Search ..... 283/62, 283/72, 81, 100, 101, 105, 109, 111, 116, 283/117, 901, 903; 229/71, 72; 40/124.01, 40/360, 625, 626, 630

See application file for complete search history.

(56) References Cited

U.S. PATENT DOCUMENTS 677,248 A * 6/1901 Meixell ..... 229/72
691,767 A * 1/1902 Herndon ..... 229/72
887,351 A * 5/1908 Smith ..... 40/530
1,944,980 A * 1/1934 Hayes ..... 229/72
2,035,218 A * 3/1936 Bloom ..... 229/71
2,148,686 A * 2/1939 Durand ..... 229/72
2,285,807 A * 6/1942 Cloutier ..... 229/72
2,363,472 A * 11/1944 Ritter ..... 229/92.8
3,329,333 A * 7/1967 Ormond ..... 229/92.5
3,525,470 A * 8/1970 Carrigan ..... 229/74
5,340,158 A * 8/1994 Bartl ..... 283/81
5,716,688 A * 2/1998 Burke et al. ..... 428/43
5,797,541 A * 8/1998 Stenner ..... 229/92.8
5,992,731 A * 11/1999 Tani ..... 229/92.8
6,129,264 A * 10/2000 Travers et al. ..... 229/72
6,499,654 B1 * 12/2002 Huff et al. ..... 229/92.8
2003/0150902 A1 * 8/2003 Huff et al. ..... 229/92.8

* cited by examiner

*Primary Examiner*—Dana Ross
(74) *Attorney, Agent, or Firm*—Armstrong Teasdale LLP

(57) ABSTRACT

A postcard includes a security tag coupled to the postcard for selectively concealing at least a portion of information displayed on the postcard. The tag includes at least a first portion and a second portion that is coupled to the first portion. The first portion is secured to the postcard with a bond that is stronger than a bond used to secure the second portion to the postcard.

22 Claims, 3 Drawing Sheets

METHOD AND APPARATUS FOR NOTIFYING A PERSON OF AN APPOINTMENT

CROSS REFERENCE TO RELATED APPLICATIONS

This application claims the benefit of U.S. Provisional Application Ser. No. 60/417,453 filed Oct. 10, 2002.

BACKGROUND OF THE INVENTION

This invention relates generally to postcards, and more particularly to appointment reminder postcards.

Missed appointments may pose a significant problem for service providers, such as doctors and dentists, or any other business entity that has scheduled an appointment with a person. For example, when a particular time has been reserved for a person, and that person does not show up, that allotted time may be unproductive if it cannot be filled with another appointment.

To facilitate reducing missed appointments, at least some known service providers mail appointment reminders to the person scheduled for the appointment. To expedite the reminder process while minimizing mailing and labor costs incurred by the service provider, often postcards are mailed to the person which include the appointment information, including the date and time of the appointment, either printed or written on the back of the postcard. However, appointment information may be sensitive, such that a person may want or require the appointment information to remain hidden during the mail or other delivery process. Accordingly, to facilitate keeping the appointment information hidden during mailing, at least some known service providers insert each postcard in an envelope prior to mailing the appointment reminders to the person scheduled for the appointment. However, mailing envelopes requires increased postage costs and may increase the amount of time and labor that must be expended by the service provider in reminding people of their appointments.

BRIEF DESCRIPTION OF THE INVENTION

In one embodiment, a postcard including a security tag coupled to the postcard for selectively concealing at least a portion of information displayed on the postcard is provided. The tag includes at least a first portion and a second portion that is coupled to the first portion. The first portion is secured to the postcard with a bond that is stronger than a bond used to secure the second portion to the postcard.

In another embodiment, a security tag for use in selectively concealing selected information displayed on a writing medium is provided. The security tag includes at least a first portion and a second portion coupled to the first portion. The first portion is secured to the writing medium with a bond that is stronger than a bond used to secure the second portion to the writing medium.

In a further embodiment, a method for notifying an individual of an appointment is provided. The method comprises providing a security tag including at least a first portion and a second portion that is coupled to the first portion, and coupling the security tag to a postcard such that selected information regarding the appointment is concealed by the security tag, and such that the security first portion is secured to the postcard with a bond that is stronger than a bond used to secure the second portion to the postcard.

DETAILED DESCRIPTION OF THE INVENTION

Figure 1:
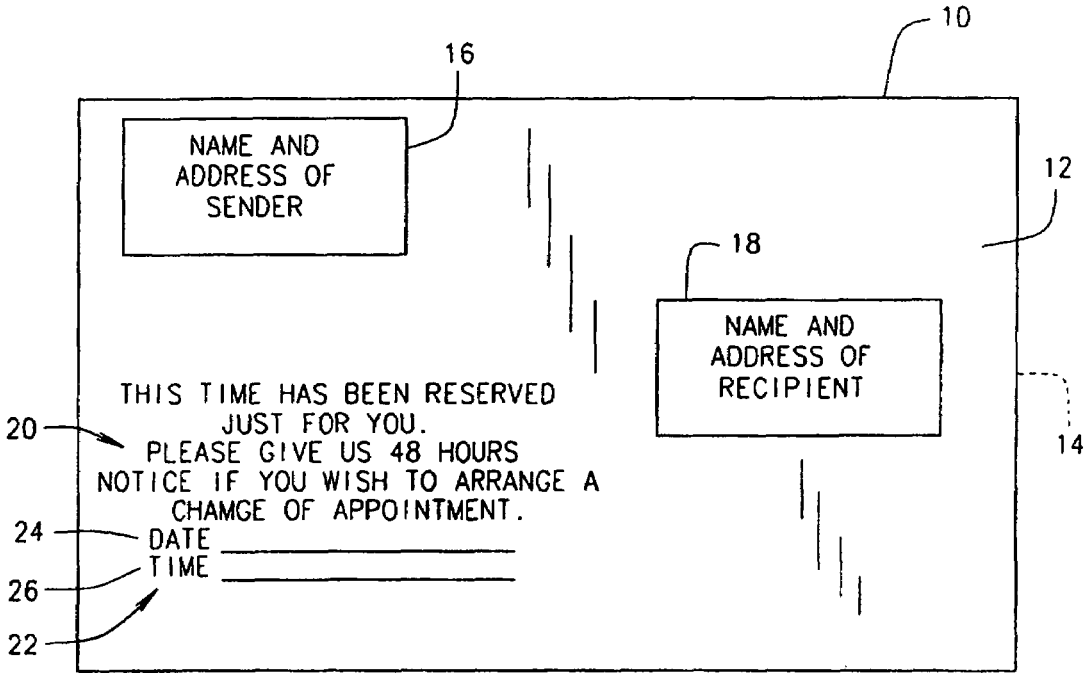
FIG. 1 is a front view of an exemplary appointment reminder postcard.

FIG. 1 is a front view of an exemplary appointment reminder postcard 10. Postcard 10 includes a front side 12 and a back side 14. In one embodiment (not shown), postcard back side 14 includes a decoration and/or message displayed thereon, such as, for example, a greeting, a personalized greeting, a picture, a drawing, an identification of the sender, an identification of the purpose of the appointment, and/or a trademarked word or symbol belonging to the sender. Postcard front side 12 includes a name and address block 16 for the sender of postcard 10, and a name and address block 18 for the recipient of postcard 10. Front side 12 also includes an appointment cancellation notice 20 and personal information 22, such as appointment information, including an appointment date 24, and an appointment time 26, displayed thereon. Although in the exemplary embodiment personal information 22 is limited to appointment information including appointment date 24 and appointment time 26, it should be understood that appointment information 22 may be any information relating to an appointment, and thus, is not limited to appointment date 24 and appointment time 26. In an alternative embodiment, postcard front side 12 does not include personal information 22, but rather includes other information 22 that a person may want kept concealed, such as, but not limited to, financial information, billing information, birthday party information, party information and directions, open house information, health insurance information, and/or personal greetings, such as romantic salutations from one individual to another.

Figure 2:
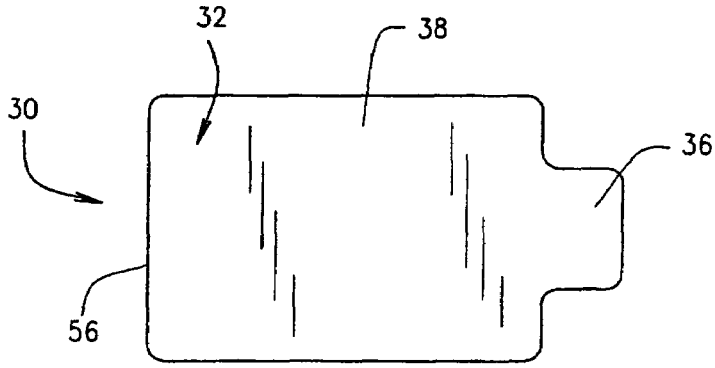
FIG. 2 is a front view of an exemplary appointment information cover in a closed position.
Figure 3:
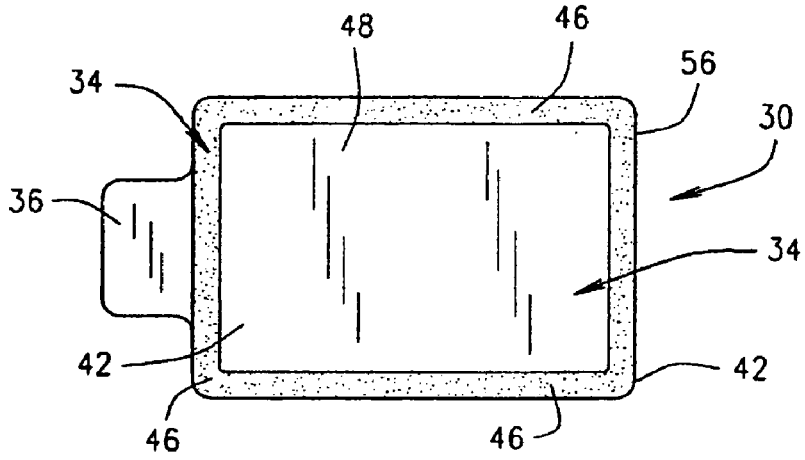
FIG. 3 is a back view of the appointment information cover shown in FIG. 2 in the closed position.
Figure 4:
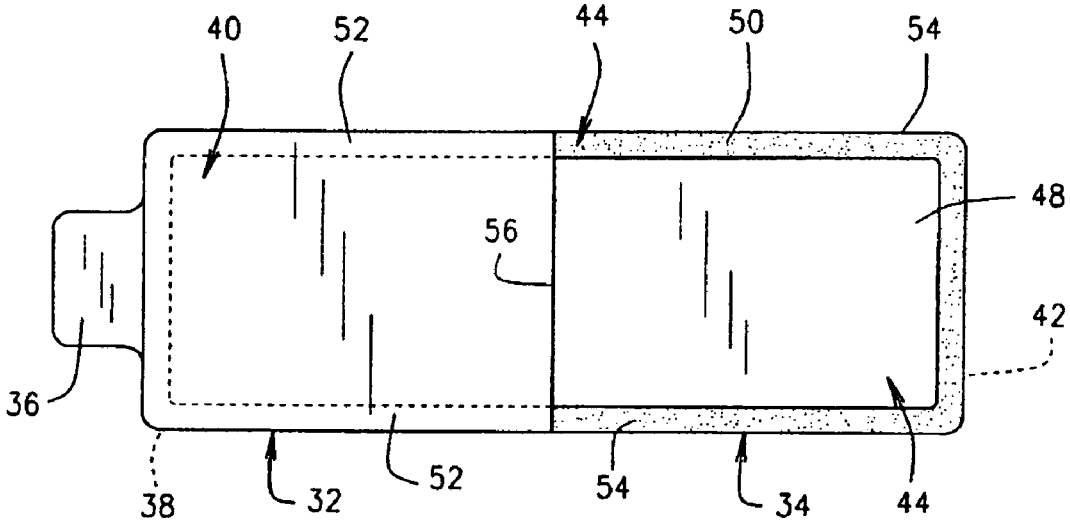
FIG. 4 is a front view of the appointment information cover shown in FIGS. 2 and 3 and in an open position.

FIG. 2 is a front view of an exemplary appointment information cover 30 for appointment information 22 (shown in FIG. 1) in a closed position. FIG. 3 is a back view of cover 30 in the closed position, and FIG. 4 is a front view of cover 30 in an open position.

As used herein, the term "writing medium" may include any material to which personal information 22 may be affixed through writing, printing, or any other of various other known processes by which information 22 is transcribed to a material for display purposes. For example, the medium may be, but is not limited to being a postcard, an envelope, a file folder, and/or a clipboard. A postcard is intended as exemplary only, and thus is not intended to limit in any way the definition and/or meaning of the term "medium". Furthermore, although the invention is described herein in association with a postcard, and more specifically for use with appointment information affixed to a postcard, it should be understood that the present invention is applicable to other writing medium which display personal information that is desired to be concealed until read by an intended recipient. Accordingly, practice of the present invention is not limited to information covers used only with postcards.

Cover 30 includes a front portion 32, a back portion 34, and a tab 36 that extends outwardly from front portion 32. Cover front portion 32 is generally opaque and includes an outer side 38 and an inner side 40. Cover back portion 34 also includes an outer side 42 and an inner side 44. In one embodiment, cover front portion 32 includes a decoration (not shown) and/or message (not shown) displayed or printed on cover front portion outer side 38, such as, for example, a greeting, a personalized greeting, a picture, a drawing, an identification of the sender, an identification of the purpose of the appointment, and/or a trademarked word or symbol belonging to the sender. Adhesive 46 extends over a portion of outer side 42 for securely attaching cover 30 to appointment reminder postcard 10.

In addition, cover back portion 34 includes a substantially transparent portion 48 that extends from cover back portion outer side 42 to cover back portion inner side 44 such that a substantially transparent window is defined therethrough. In an alternative embodiment, cover back portion 34 does not include transparent portion 48, but rather includes an opening (not shown) that extends through cover back portion 34 from cover back portion outer side 42 to cover back portion inner side 44.

When cover 30 is in the closed position (shown in FIGS. 2 and 3), a portion 50 of cover back portion inner side 44 is coupled to a portion 52 of cover front portion inner side 40. In the exemplary embodiment, portion 50 is attached to portion 52 using an adhesive 54 applied to portion 50. Adhesive 54 possesses less adhesive strength than the adhesive strength that cover adhesive 46 possesses. In an alternative embodiment (not shown), portion 50 is attached to portion 52 using an adhesive applied to portion 52. In another alternative embodiment, portion 50 is attached to portion 52 using an adhesive 46 applied to both portions 50 and 52.

Cover 30 is opened from the closed position to the open position (shown in FIG. 4) by peeling or bending cover front portion 32 back and away from cover back portion 34, such that the adhesive bond created between portions 50 and 52 is broken. Accordingly, when cover 30 is in the open position, at least a portion of cover front portion 32 is removed from cover back portion 34, and therefore postcard 10. Because the adhesive bond created by adhesive 46 is sufficiently stronger than the adhesive bond created between cover back portion 34 and cover front portion 32 by adhesive 54, cover front portion 32 is removable from cover back portion 34 without breaking the adhesive bond between cover back portion 34 and postcard 10.

In one embodiment, cover 30 includes a security indicator (not shown) that indicates whether cover 30 has been opened, after cover 30 has been attached to postcard 10, and therefore may indicate that the personal information displayed or written below cover 30 may have been viewed by a person other than the postcard's intended recipient. For example, in one embodiment the security indicator is a strip (not shown) that is fixedly attached to postcard 10 and extends over at least a portion of cover 30. More specifically, the strip is positioned to be broken when cover 30 is at least partially opened. In the exemplary embodiment, cover front portion 32 and cover back portion 34 remain attached to each other at a fold 56 when in cover 30 is in the open position. In an alternative embodiment, cover back portion 34 is completely removable from cover front portion 32 when in cover 30 is in the open position.

In an alternative embodiment (not shown), cover portion 50 is fixedly secured to portion 52 of cover front portion inner side 40 using any suitable means, and a portion of cover front portion 32 is perforated at an inner boundary of portion 52. In such an alternative embodiment, cover 30 is opened from the closed position to the open position by peeling cover front portion 32 back and away from cover back portion 34 such that the perforations break, thereby breaking the attachment between portion 52 and the remaining portion of cover front portion 32.

Figure 5:
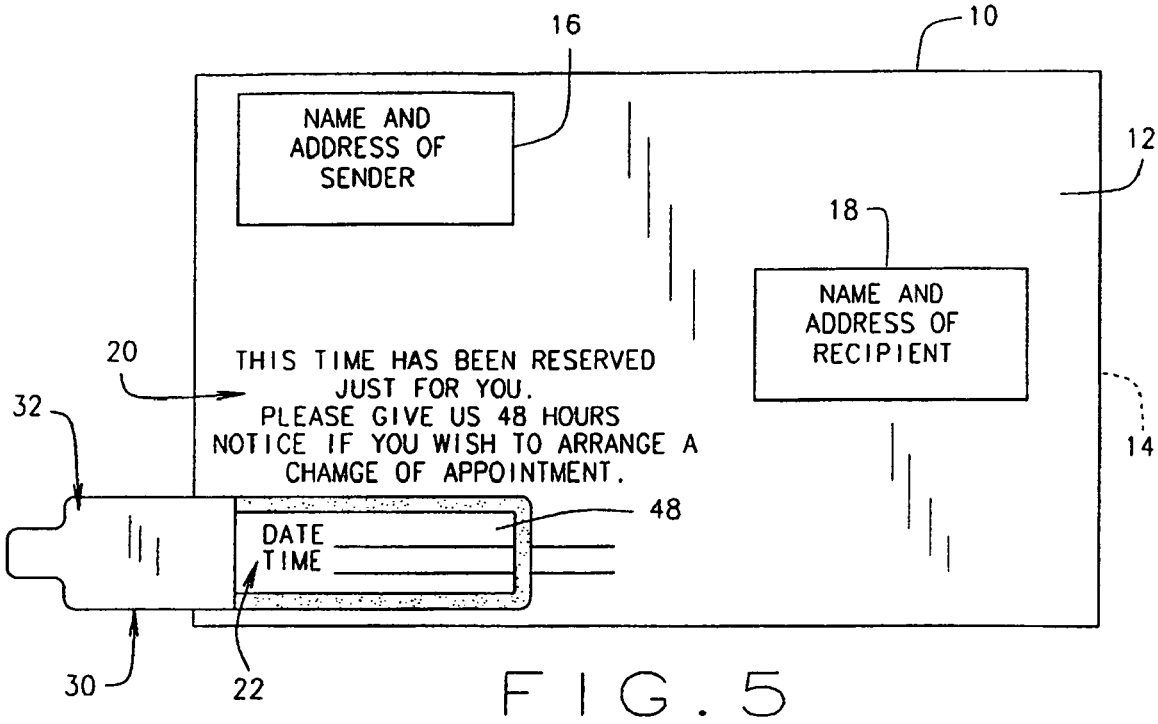
FIG. 5 is a front view of the appointment reminder postcard shown in FIG. 1 including the appointment information cover shown in FIGS. 2-4 attached thereto.

FIG. 5 is a front view of appointment reminder postcard 10 including appointment information cover 30 attached thereto and in an open position. When cover 30 is attached to postcard 10, and cover 30 is in the closed position (shown in FIGS. 2 and 3), cover front portion 32 substantially covers appointment information 22 such that personal information 22 is not visible through cover front portion 32. When cover 30 is attached to postcard 10 and cover 30 is in the open position (shown in FIGS. 4 and 5), appointment information 22 is visible through transparent portion 48. In an alternative embodiment described above, appointment information 22 is visible through an opening (not shown) defined in cover back portion 34. In one embodiment, postcard 10 includes an indicator line (not shown) for indicating an approximate location where cover 30 should be attached to postcard 10 to allow cover 30 to substantially cover personal information 22.

In an alternative embodiment, cover back portion 34 does not include transparent portion 48 and personal information 22 is written on, and displayed on cover back portion inner surface 44 when cover is opened. In an alternative embodiment, personal information 22 is not written, but rather is affixed to postcard 10 or cover back portion inner surface 44, such as with, but not limited to, a self-adhesive label or decal. In such an embodiment, cover front portion 32 covers information 22 when cover 30 is in the closed position, and accordingly, personal information 22 is visible on cover back portion inner surface 44 when cover is in the open position. Furthermore, in such an embodiment, cover 30 is affixed to postcard 10 in an open position and prior to personal information 22 being written on cover back portion inner surface 44.

Overall dimensions and a shape of cover 30 are variably selected. More specifically, in an alternative embodiment, cover 30 extends over substantially all of postcard front side 12, and name and address block 18 is written on cover back portion 34, after cover 30 is closed to conceal personal information written on postcard front side 12. In a further alternative embodiment, name and address block 18 are written on postcard front side 12 as described above, and cover 30 extends over substantially all of postcard front side 12 and includes a transparent window, such that address block 18 is the only written material viewable through cover 30 when cover 30 is affixed to postcard 12 in the closed position. In yet another embodiment, cover 30 is sized to cover substantially all of postcard front side 12, but includes a recessed area that enables address block 18 to be viewable when cover 30 is in the closed position.

Figure 6:
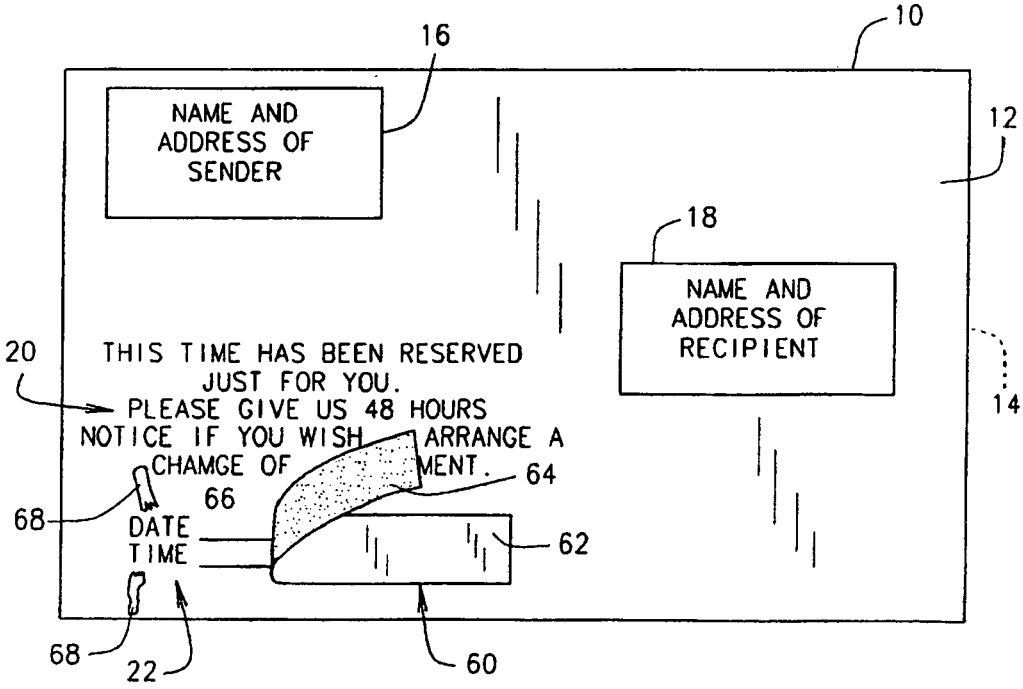
FIG. 6 is a front view of the appointment postcard shown in FIG. 1 and including an alternative embodiment of the appointment information cover shown in FIGS. 2-4.

FIG. 6 is a front view of appointment postcard 10 including an alternative embodiment of an appointment information cover 60. Cover 60 includes a first side 62 and a second side 64. Cover second side 64 includes an adhesive 66 for attaching cover 60 to postcard 10. Cover 60 is attached to postcard 10 using adhesive 66 such that personal information 22 is substantially covered by cover 60. Cover 60 is generally opaque such that when cover 60 substantially covers appointment information 22, appointment information 22 is not visible through cover 60. An adhesive bond created between cover 60 and postcard 10 by adhesive 66 generally strong enough to retain cover 60 to postcard 10 during normal mail or delivery service, and is weak enough to permit at least a portion of cover 60 to be detached, or removed, from postcard 10 without substantial destruction of the displayed personal information 22.

When viewing of personal information 22 is desired by the postcard's recipient, at least a portion of cover 60 is peeled back and away from postcard front side 12 such that information 22 is visible. In one embodiment, a portion of cover 60 does not include adhesive 66 to facilitate removal of cover 60 from postcard 10. Furthermore, cover 60 includes at least one strip 68 that is fixedly attached to postcard 10 and is broken when cover 30 is at least partially opened to reveal if appointment information 22 has been viewed by a person other than the postcard's recipient after cover 60 has been attached to postcard 10.

The above-described appointment information cover is a cost-effective and highly reliable means for ensuring that appointment or personal information remains private. More specifically, the information cover extends over personal information to substantially prevent the information from being visible during mail or delivery service of the postcard. The cover can then be easily removed by the postcard's intended recipient to reveal the personal information. As a result, the cover facilitates ensuring personal and appointment information remains private in a cost-effective and reliable manner.

Exemplary embodiments of appointment reminder postcards are described above in detail. The postcards are not limited to the specific embodiments described herein, but rather, components of each postcard may be utilized independently and separately from other components described herein. Each postcard component can also be used in combination with other postcard components.

While the invention has been described in terms of various specific embodiments, those skilled in the art will recognize that the invention can be practiced with modification within the spirit and scope of the claims.

What is claimed is:

1. A postcard comprising a security tag coupled to said postcard for selectively concealing at least a portion of information displayed on said postcard, said tag comprising at least a first portion and a second portion coupled to said first portion, wherein said first portion comprises an unperforated body comprising a first side and an opposite second side, and wherein said second portion comprises an unperforated body comprising a first side and an opposite second side, said first portion first side coupled against said postcard, said second portion first side coupled against said first portion second side, said first portion secured to said postcard with a bond that is stronger than a bond used to secure said second portion to said postcard.

2. A postcard in accordance with claim 1 wherein said second portion is at least partially removable from said postcard without breaking the bond formed between said first portion and said postcard.

3. A postcard in accordance with claim 1 wherein at least a section of said security tag is substantially transparent, said transparent portion enables selective viewing of the information displayed on said postcard.

4. A postcard in accordance with claim 1 wherein said security tag further comprises an opening extending through at least a section of said security tag, said opening enables selective viewing of the information displayed on said postcard.

5. A postcard in accordance with claim 1 wherein the information desired to be concealed is contained on said first portion second side.

6. A postcard comprising a security tag coupled to said postcard for selectively concealing at least a portion of information displayed on said postcard, said tag comprising at least a first portion and a second portion coupled to said first portion, wherein said first portion comprises a first side and an opposite second side, and wherein said second portion comprises a first side and an opposite second side, wherein at least a section of one of said first portion and said second portion is substantially transparent, said first portion further comprising a pair of oppositely-disposed ends and a body extending therebetween, said second portion first side and said first portion ends coupled against said postcard, said first portion body coupled against said second portion second side, said first portion secured to said postcard with a bond that is stronger than a bond used to secure said second portion to said postcard.

7. A security tag for use in selectively concealing selected information displayed on a writing medium, said security tag comprising at least a first portion and a second portion coupled to said first portion, wherein said tag first and second portions each comprise an outer surface and an opposite inner surface, said second portion further comprises a tab formed unitarily therewith such that said tab is removable from said first portion only when said second portion is removed from said first portion, said tag first portion outer surface is coupled against the writing medium, said tag second portion extends over said tag first portion inner surface such that said second portion inner surface is coupled against said first portion inner surface, said first portion secured to the writing medium with a bond that is stronger than a bond used to secure said second portion to the writing medium.

8. A security tag in accordance with claim 7 wherein at least a section of said second portion is at least partially removable from said writing medium without removing said security tag first portion from said writing medium.

9. A security tag in accordance with claim 7 wherein the information desired to be concealed is affixed to at least one of said first portion inner surface and the writing medium.

10. A security tag for use in selectively concealing selected information displayed on a writing medium, said security tag comprising at least a first portion and a second portion coupled to said first portion, wherein said tag first and second portions each comprise an outer surface and an opposite inner surface each having a substantially uniform thickness, said tag first portion further comprises a first end, a second end, and a body extending therebetween, each of said first portion first and second ends, and said second portion inner surface is coupled against the writing medium, said first portion body is coupled only against said second portion outer surface, said first portion secured to the writing medium with a bond that is stronger than a bond used to secure said second portion to the writing medium.

11. A security tag in accordance with claim 7 wherein at least a section of at least one of said first portion and said second portion is substantially transparent.

12. A security tag in accordance with claim 7 further comprising an opening extending through at least a section of at least one of said first portion and said second portion.

13. A method for notifying an individual of an appointment, said method comprising:

providing a security tag including at least a first portion and a second portion that is coupled to the first portion, wherein the first portion comprises an unperforated body comprising a first side and an opposite second side, and wherein the second portion comprises an unperforated body comprising a first side and an opposite second side, the second portion first side coupled against the first portion second side; and coupling the security tag to a postcard such that selected information regarding the appointment is concealed by the security tag, and such that the security tag first portion is secured to the postcard with a bond that is stronger than a bond used to secure the second portion to the postcard.

14. A method in accordance with claim 13 further comprising affixing the information to be concealed to at least one of the security tag and the postcard.

15. A method in accordance with claim 13 wherein coupling the security tag to a postcard further comprises coupling the security tag to the postcard such that the tag second portion is at least partially removable from the postcard without breaking the bond formed between the first portion and the postcard.

16. A method in accordance with claim 13 wherein coupling the security tag to a postcard further comprises coupling a security tag to the postcard that includes at least a section that is substantially transparent to facilitate viewing of the selected information.

17. A method in accordance with claim 13 wherein coupling the security tag to a postcard further comprises coupling a security tag to the postcard that includes at least one opening extending at least partially therethrough to facilitate viewing the selected information.

18. A postcard comprising a security tag coupled to said postcard for selectively concealing at least a portion of information displayed on said postcard, said postcard comprising a pair of oppositely-disposed ends and a body extending therebetween, said tag comprising at least a first portion and a second portion separated by a fold line, said first portion comprises a first side and an opposite second side, said second portion comprises a first side, an opposite second side, and a tab formed unitarily with said second portion such that said tab is removable from said first portion only when said second portion is removed from said first portion, said tag coupled to said postcard such that tag first portion second side is coupled between tag second portion second side and said tag first portion first side, said tag configured to remain folded until the information is revealed, at least one of said tag first portion and said tag second portion comprises a substantially transparent material.

19. A postcard in accordance with claim 18 wherein at least one of said tag first portion and said tag second portion is coupled adjacent to an outer periphery of said postcard.

20. A postcard in accordance with claim 18 wherein at least one of said tag first portion and said tag second portion comprises a message and/or information.

21. A postcard in accordance with claim 18 wherein said tag first portion second side and said tag second portion second side are secured to said postcard second side with an adhesive bond.

22. A postcard in accordance with claim 18 wherein said security tag is substantially rectangular.

* * * * *